United States Patent [19]

Taylor et al.

[11] 4,139,032

[45] Feb. 13, 1979

[54] LIQUID DISPENSING NOZZLE HAVING CONTROLLED SHUT-OFF MECHANISM

[75] Inventors: Charles W. Taylor, Batavia; Donald A. Lasater, Fairfield; Steven R. Ebbesmeyer, Middletown, all of Ohio

[73] Assignee: Dover Corporation, New York, N.Y.

[21] Appl. No.: 803,515

[22] Filed: Jun. 6, 1977

[51] Int. Cl.[2] ..... B67C 3/34; B65B 31/06

[52] U.S. Cl. ..... 141/206; 141/225; 141/392; 137/513.3

[58] Field of Search ..... 141/192–229, 141/291–296, 301–308, 52, 59, 44, 45, 1, 4, 5; 220/85 VR, 85 VS, 86 R; 137/513.3

[56] References Cited

U.S. PATENT DOCUMENTS 3,907,010 9/1975 Burns et al. ..... 141/52

*Primary Examiner*—Houston S. Bell, Jr.

*Attorney, Agent, or Firm*—John G. Schenk

[57] ABSTRACT

In an automatic shut-off nozzle, the vacuum chamber, which has its vacuum increased when flow through the nozzle is to be stopped in response to a predetermined condition such as the tank being filled to a predetermined level, for example, has the reduction in the vacuum therein controlled so that the automatic shut-off mechanism cannot be returned to its latching position by the attendant for a predetermined period of time after having been activated. A check valve allows removal of air from the chamber to increase the vacuum in response to the predetermined condition while preventing flow of air into the chamber. The flow of air into the chamber to reduce the vacuum therein must be through metering means so that a predetermined period of time must elapse until the vacuum in the chamber has been reduced by the air flow through the metering means to enable the shut-off mechanism to be latched.

14 Claims, 14 Drawing Figures

LIQUID DISPENSING NOZZLE HAVING CONTROLLED SHUT-OFF MECHANISM

When filling a vehicle tank with gasoline through a dispensing nozzle, vapors from the gasoline within the tank can be prevented from escaping through the fill pipe opening in which the spout of the nozzle is inserted by sealing the fill pipe opening. Thus, the escape of the gasoline vapors into the atmosphere is prevented so that pollution of the atmosphere is decreased. The vapors within the tank can be recovered through vapor recovery equipment utilized in conjunction with the nozzle.

However, with vapor recovery arrangements, it is necessary for there to be automatic shut off of the supply of gasoline. This is because the attendant cannot see the level of the gasoline within the vehicle tank being filled because of the sealing of the fill pipe opening.

Therefore, the supply of gasoline to the vehicle tank must be automatically stopped. One type of automatic shut-off mechanism utilizes a vacuum chamber having a diaphragm forming one wall thereof so that an increase in the vacuum within the vacuum chamber moves the diaphragm to activate release means to automatically move the valve, which controls the liquid flow from the inlet to the outlet of the nozzle body, to its closed position.

The vacuum in the vacuum chamber is increased whenever vacuum passage means, which provide communication from the vacuum chamber to a vacuum passage opening in the nozzle spout, is blocked between means creating a partial vacuum in the vacuum chamber and the vacuum passage opening in the nozzle spout. This can occur when the level of the liquid in the tank being filled reaches a predetermined level to block the vacuum passage opening in the nozzle spout or when a valve blocks the vacuum passage intermediate the vacuum passage opening and the partial vacuum creating means in response to the vapor pressure in the tank increasing beyond a predetermined level.

When either condition exists, the partial vacuum creating means increases the vacuum in the vacuum chamber by withdrawing air therefrom to cause the diaphragm to move to activate the release means to move the valve, which controls the liquid flow from the inlet to the outlet of the nozzle body, to its closed position. Since the tank being filled communicates through a vapor return passage to the vapor recovery equipment, gasoline could be pumped through the nozzle spout to the tank and then returned to the vapor recovery equipment through the vapor return passage if the automatic shut-off mechanism could be latched again by the attendant as soon as the mechanism has moved the valve to its closed position. This is because a small quantity of liquid would flow through the spout before the valve would again be automatically closed by the increased partial vacuum in the vacuum chamber since liquid flow must occur through the nozzle body to produce the vacuum in the vacuum chamber.

By this arrangement, an attendant could deceive a customer into paying for gasoline not received permanently in the tank of the customer since the gasoline would be pumped into the tank and then through the vapor return passage to the vapor recovery equipment by the attendant activating the automatic shut-off mechanism several times in quick succession. The customer would not be able to notice that this was occurring since the flow of gasoline into the fill pipe of the tank cannot be observed because of the vapor seal fitting around the fill pipe opening. Thus, the return of the gasoline from the tank to the vapor return passage also cannot be observed by the customer.

The present invention satisfactorily solves the foregoing problem through preventing latching of the shut-off mechanism. by the attendant for a predetermined period of time after the shut-off mechanism has been activated. The length of this period of time is selected to discourage the attendant from attempting to pump additional gasoline through the nozzle into the customer's tank and then from the tank to the vapor recovery equipment through the vapor return passage.

The present invention accomplishes this through providing a check valve in the vacuum passage means between the chamber and the communication of the partial vacuum creating means with the vacuum passage means so that the partial vacuum, which is created by the flow of gasoline through the nozzle body, can be produced within the vacuum chamber. Additionally, the vacuum in the vacuum chamber can be increased when the vacuum passage opening in the nozzle spout is blocked by the level of the gasoline in the tank being filled or communication between the vacuum passage opening in the nozzle spout and the vacuum chamber is prevented by a valve, which is between the vacuum passage opening in the nozzle spout and the communication of the partial vacuum creating means with the various passage means, being closed by the vapor pressure within the tank exceeding a predetermined pressure. When either condition exists within the tank, the check valve of the present invention allows removal of additional air from the vacuum chamber by the partial vacuum creating means to increase the vacuum therein. However, as soon as flow of gasoline through the nozzle body is topped, the check valve prevents return flow of air into the vacuum chamber to decrease the vacuum therein. It is necessary for the vacuum in the vacuum chamber to be decreased for the diaphragm to be returned to the position in which the automatic shut-off mechanism can again be latched by the attendant.

The present invention utilizes a metered orifice or passage to control the length of time that is required for the vacuum in the vacuum chamber to be reduced through flow of air through the orifice or passage to the vacuum chamber. This period of time is selected through controlling the flow of air through the metered orifice or passage by controlling the size of the metered orifice or passage and/or the length of the metered orifice or passage.

An object of this invention is to provide an arrangement for controlling relatching of the automatic shut-off mechanism of a liquid dispensing nozzle.

Another object of this invention is to provide a liquid dispensing nozzle having an automatic shut-off mechanism that is rendered ineffective for a predetermined period of time after being activated.

A further object of this invention is to provide an automatic shut-off nozzle having vapor return sealing means in which accurate dispensation of the liquid is obtained.

Other objects, uses, and advantages of this invention are apparent upon a reading of this description which proceeds with reference to the drawings forming part thereof and wherein.

Figure 1:
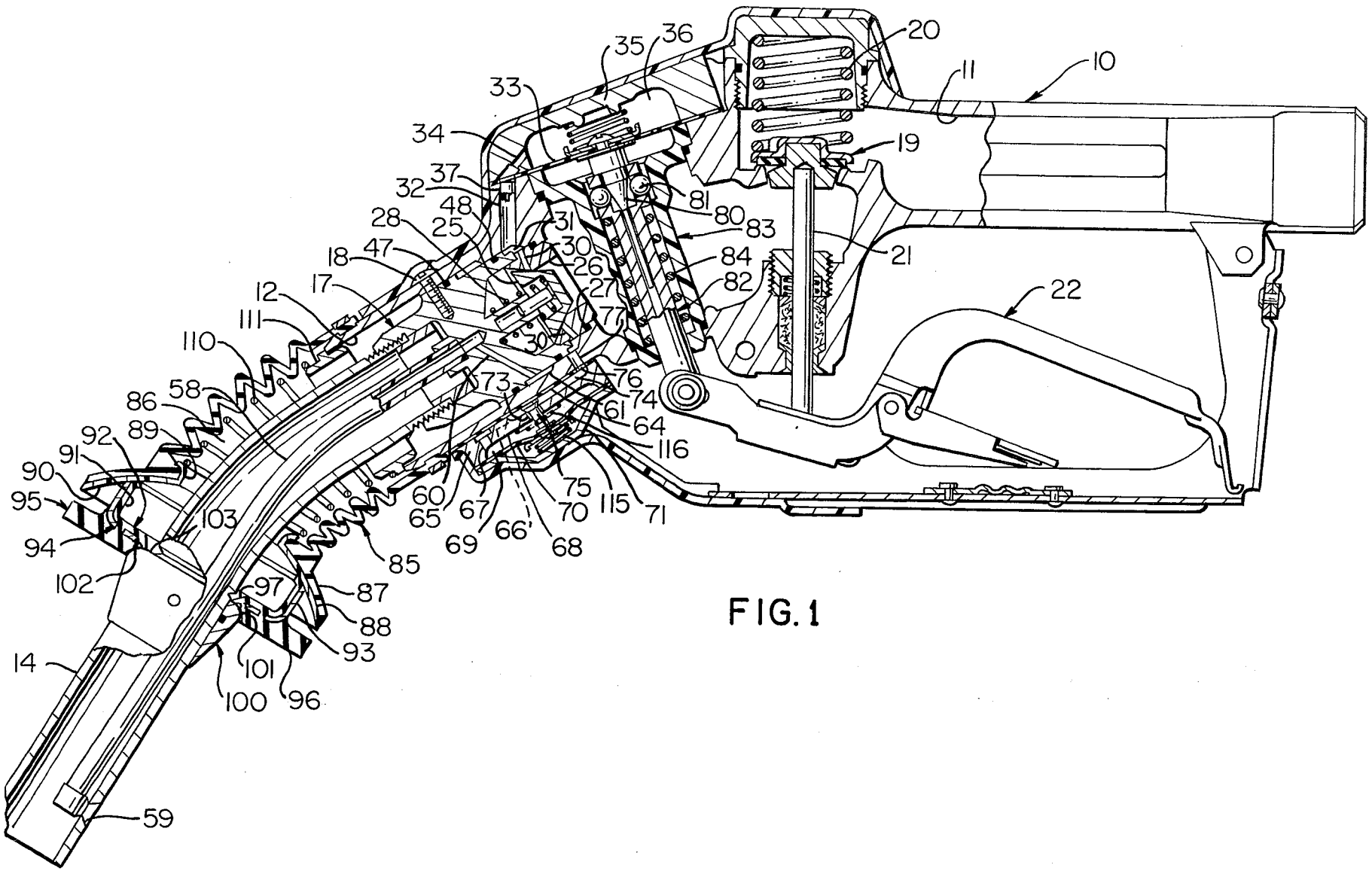
FIG. 1 is a sectional view, partly in elevation, of an automatic shut-off nozzle having one form of the control means of the present invention.

Referring to the drawings and partiularly FIG. 1, there is shown a nozzle body 10 having an inlet 11 to which a hose is connected to supply liquid such as gasoline, for example, to the interior of the body 10. The body 10 has an outlet 12 with which a spout 14 communicates to receive liquid from the interior of the body 10.

The spout 14, which is adapted to be inserted within an opening 15 (see FIG. 5) in a fill pipe 16 of a vehicle tank such as an automobile fuel tank, for example, has an end threaded in a spout adapter 17 (see FIG. 1), which is connected to the outlet 12 of the body 10 by a screw 18.

The body 10 has a first or main poppet valve 19 supported therein for control of the flow of liquid from the inlet 11 to the interior of the body 10 and from the interior of the body 10 to the outlet 12. A spring 20 continuously urges the poppet valve 19 to its closed position in which flow from the inlet 11 to the outlet 12 is stopped or prevented.

A stem 21 is connected to the poppet valve 19 and has its lower portion extending exteriorly of the body 10. The valve stem 21, which is slidably disposed within the body 10, is moved by a manually operated lever or handle 22. The stem 21 passes through the body 10 in the same manner as described in U.S. Pat. No. 3,811,486 to Wood.

A second poppet valve 25 is slidably mounted on the spout adapter 17 and is continuously urged into engagement with a seat ring 26, which is secured to the spout adapter 17 and has a sealing ring 27 disposed therebetween to prevent leakage therebetween, by a spring 28. Thus, only the pressure of liquid going from the inlet 11 and past the valve 19 can overcome the spring 28 and move the second poppet valve 25 to an open position.

As the liquid flows between the second poppet valve 25 and the seat ring 26, a venturi effect is created in radially extending passages 30 in the seat ring 26. The outer ends of the passages 30 communicates with an annular chamber 31, which is formed between the body 10, the spout adapter 17, and the seat ring 26. The passages 30 communicate through the chamber 31, a passage 32 in the body 10, an opening in a diaphragm 33, and a passage 34 in a cap 35 to a chamber 36, which is formed between the diaphragm 33 and the cap 35.

Figure 2:
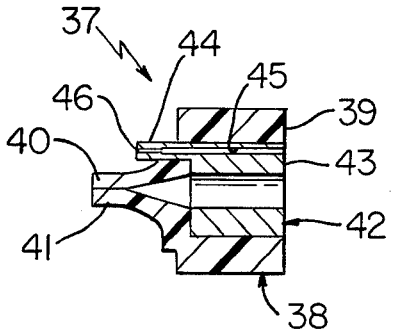
FIG. 2 is a sectional view of the control means of FIG. 1.
Figure 3:
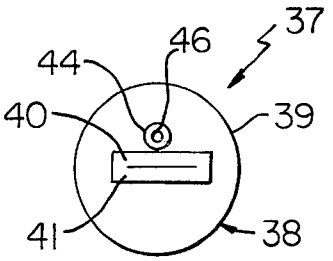
FIG. 3 is an end view of the control means of FIG. 2 in its closed position.

The passage 32 in the body 10 has control means 37 mounted therein to enable air to be removed from the chamber 36 and to meter the flow of air to the chamber 36 from the chamber 31. The control means 37 includes a duckbill check valve 38 (see FIGS. 2 and 3), which is formed of a suitable elastomer material. The duckbill check valve 38 includes a hollow cylindrical shaped body 39 having a pair of lips 40 and 41 formed integral therewith and extending from one end thereof. The lips 40 and 41 normally engage each other to form a seal therebetween. However, when a lesser pressure is applied to the lips 40 and 41 of the duckbill check valve 38 than exists in the chamber 36, air is withdrawn from the chamber 36 to increase the vacuum therein.

The body 39 of the duckbill check valve 38 has an insert 42, which is formed of a suitable plastic material which may be molded integral therewith or made separate therefrom and thereafter inserted. The insert 42 includes a hollow cylindrical body 43 having an extension 44 extending therefrom and through the body 39 of the duckbill check valve 38. A longitudinal passage 45 extends through the portion of the body 43 aligned with the extension 44 and into a portion of the extension 44. The passage 45 communicates with a passage 46, which is of substantially smaller diameter than the passage 45 so as to meter the flow of air therethrough, in the extension 44.

Accordingly, the control means 37 is capable of allowing uncontrolled flow of air from the chamber 36 through the hollow body 43 of the insert 42 and between the lips 40 and 41 of the duckbill check valve 38 when there is a greater pressure in the chamber 36 than in the chamber 31. When this pressure differential ceases to exist and the pressure in the chamber 31 becomes greater than in the chamber 36, air flows at a metered rate from the chamber 31 to the chamber 36 to decrease the vacuum therein by flowing through the passages 45 and 46.

Sealing rings 47 and 48 (see FIG. 1) are disposed between the spout adapter 17 and the body 10. These prevent air from entering the chamber 31 exterior of the body 10.

The chamber 31 also communicates with a vacuum tube 58, which is connected with an opening 59 in the spout 14 adjacent the discharge or free end of the spout 14. The tube 58 communicates through a passage 60 in the spout adapter 17 with a chamber 61, which is formed between the sealing rings 47 and 48, the spout adapter 17, and the body 10. The chamber 61 communicates through a passage (not shown) in the nozzle body 10 and an opening (not shown) in a diaphragm 64, which is disposed between the body 10 and a housing 65 secured to the body 10, to a horseshoe-shaped passage 66 in the housing 65. This is more particularly shown and described in the copending patent application of Jack A. McMath for "Automatic Shut-Off Nozzle With Vapor Return Seal," Ser. No. 684,441, filed May 7, 1976, and assigned to the same assignee as the assignee of this application, and now abandoned.

The horseshoe-shaped passage 66 in the housing 65 communicates through a passage 67 in a divider 68 of the housing 65 with a chamber 69, which is formed between the divider 68 and a diaphragm 70. A retainer 71 holds the diaphragm 70 on the housing 65.

The chamber 69 communicates through a passage 73 in the divider 68 of the housing 65 with a chamber 74, which is formed within the housing 65 between the divider 68 and the diaphragm 64. The passage 73 is controlled by a poppet valve 75, which is responsive to the diaphragm 70. The chamber 74 communicates through an opening 76 in the diaphragm 64 and a passage 77 in the body 10 with the annular chamber 31.

Figure 4:
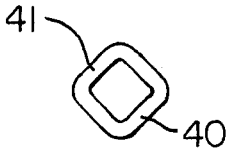
FIG. 4 is an end view of the duckbill check valve of the control means and showing the duckbill check valve in its open position.

Accordingly, as long as the poppet valve 75 is open and the opening 59 is not closed due to the liquid within the tank reaching a predetermined level that indicates that the tank is filled, the venturi effect created by the flow of the liquid between the seat ring 26 (see FIG. 1) and the poppet valve 25 draws air through the tube 58 to create a partial vacuum within the chamber 36. The pressure differential across the lips 40 and 41 of the duckbill check valve 38 causes them to open to the position of FIG. 4 so that air can be easily withdrawn from the chamber 36 to create the partial vacuum therein.

However, as soon as the opening 59 is blocked or the valve 75 is closed, the chamber 36 has its pressure reduced due to the air therein being drawn therefrom through the duckbill check valve 38 because of the venturi effect in the passages 30 whereby the diaphragm 33 moves upwardly since the partial vacuum in the chamber 36 is increased. This venturi effect is more particularly described in U.S. Pat. No. 3,085,600 to Briede.

The diaphragm 33 has a latch retaining pin 80 secured thereto for movement therewith and disposed between three balls 81 (two shown), which are positioned within passages in a latch plunger 82. When the latch retaining pin 80 is in the position shown in FIG. 1, the balls 81 prevent downward movement of the plunger 82, which is slidably mounted within an insert 83. The insert 83, which is preferably formed of a plastic, is support in the body 10.

When the diaphragm 33 is moved upwardly due to the increase in the partial vacuum in the chamber 36, the latch retaining pin 80 is moved upwardly therewith. The upward movement of the retaining pin 80 disposes a tapered portion of the retaining pin 80 between the balls 81 whereby the balls 81 may move inwardly to allow the plunger 82 to be moved downwardly against the force of its spring 84. The correlation between the tapered portion of the pin 80 and the latch plunger 82 is more specifically shown in U.S. Pat. No. 2,582,195 to Duerr.

The lower end of the plunger 82 is connected to the handle 22 as more particularly shown and described in U.S. Pat. No. 3,817,285 to Wilder et al. Thus, when the diaphragm 33 moves upwardly to pull the latch retaining pin 80 and release the latch plunger 82 from the balls 81, the force of the spring 20 closes the main poppet valve 19 as more particularly shown and described in the aforesaid Wilder et al patent.

The body 10 has a bellows 85, which is preferably formed of a gasoline resistant synthetic rubber, secured thereto and extending from the outlet 12 of the body 10 towards the free or discharge end of the spout 14. The bellows 85 is disposed in spaced relation to the spout 14 to form an annular passage 86 therebetween.

The end of the bellows 85 remote from the outlet 12 of the body 10 has a member 87, which is preferably formed integral therewith. the member 87 has a member 88, which is plastic such as Delrin, for example, connected thereto by the member 88 having its curved portion snapped into the bellows 85 and retained therein by the resilience of the bellows 85. The member 88 has an opening 89 formed in the center thereof to enable the member 88 to slide along the spout 14.

The member 88 has its surface 90 formed as a sector of a sphere so that a cylindrical extension 91 of a member 92, which is preferably formed of the same material as the member 87, engages the surface 90 irrespective of the position of the member 92 on the spout 14. The member 92 has its cylindrical extension 91 supported by a cylindrical extension 93 of a plate 94, which is preferably formed of a suitable material such as stainless steel, for example. The member 92 is molded integral with the plate 94 so that the cylindrical extension 91 of the member 92 is secured to the cylindrical extension 93 of the plate 94.

The plate 94 has openings formed therein so that the member 92 has a disc 95 disposed on the opposite side of the plate 94 from the cylindrical extension 91. Thus, the member 92, the plate 94, and the disc 95 form a sealing member with the disc 95 having its flat surface 96 functioning as a sealing surface. The member 92, the plate 94, and the disc 95 have an opening 97 to enable them to be both slidably and rotatably mounted on the spout 14.

A retainer 100, which functions as a stop, is fixed to the spout 14 between the disc 95 and the discharge or free end of the spout 14 by suitable means such as a set screw or welding, for example. The retainer 100 has a curved surface 101, preferably formed as a portion of a sphere as more particularly shown and described in the copending patent application of Donald A. Lasater for "Liquid Dispensing Nozzle Having Vapor Recovery And Sealing Arrangement," Ser. No. 581,718, filed May 29, 1975, and now U.S. Pat. No. 4,003,415 and assigned to the same assignee as the assignee of this application. The disc 95 has an inner curved surface 102, preferably formed as a sphere as more particularly shown and described in the aforesaid Lasater application, engaging the curved surface 101 of the retainer 100 to form a seal therewith when the spout 14 is not inserted within the opening 15 of the fill pipe 16.

The retainer 100 has an inner flat surface 103, which is disposed inside of the surface 101. The surface 103 functions to lock the spout 14 within the fill pipe 16 through cooperation with a lip 104 of the fill pipe 16 as shown in FIG. 5.

Accordingly, when the spout 14 is not inserted in the opening 15 of the fill pipe 16, the annular passage 86, which is connected to the vapor recovery equipment, is not connected to the atmosphere but is sealed through the cylindrical extension 91 of the member 92 engaging the surface 90 of the member 88 and the disc 95 having its inner curved surface 102 engage the outer curved surface 101 of the retainer 100. When the spout 14 is inserted into the opening 15 (see FIG. 5) of the fill pipe 16, the outer flat surface 96 of the disc 95 abuts the end of the fill pipe 16 so as to not follow the movement of the spout 14 and the retainer 100 into the fill pipe 16. This results in the bellows 85, which continuously urges the member 88 toward the free end of the spout 14 so that the spherical surface 90 of the member 88 is always in engagement with the cylindrical extension 91 of the member 92 and the cylindrical extension 93 of the plate 94, being slightly compressed.

Figure 5:
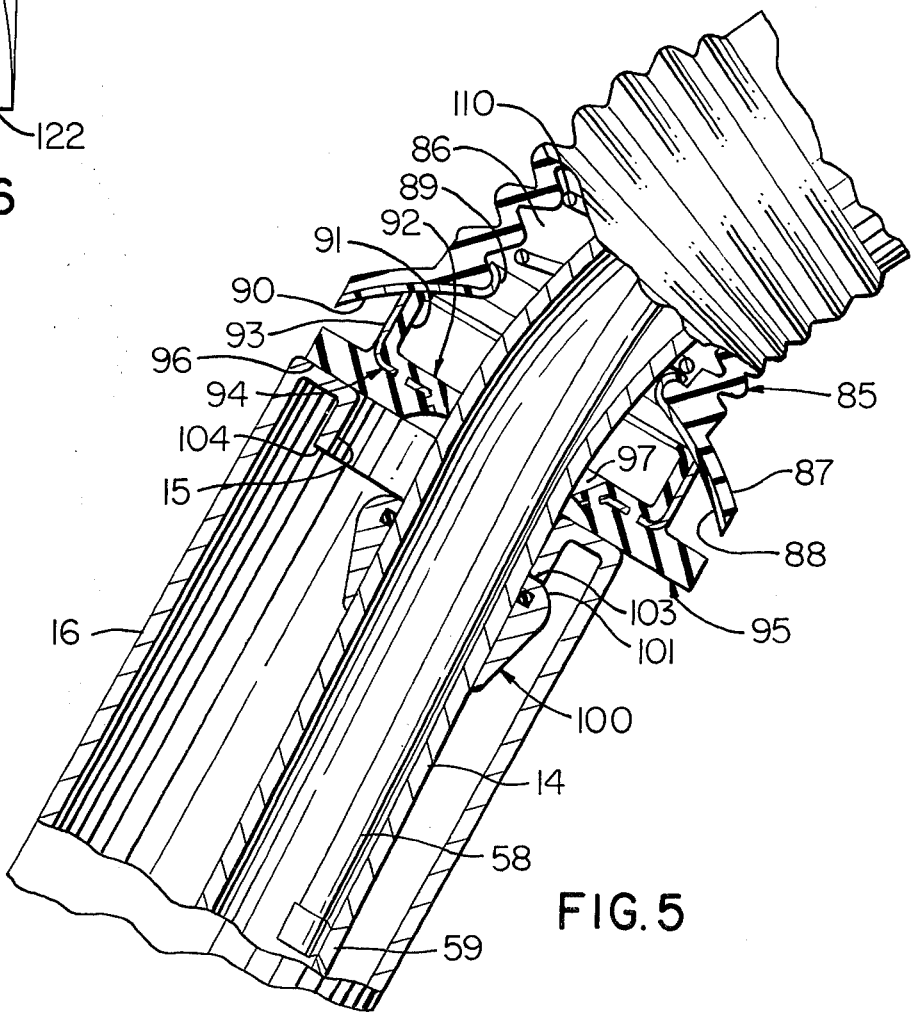
FIG. 5 is a fragmentary sectional view, partly in elevation, of a portion of the nozzle of FIG. 1 and showing the spout in the fill pipe of a vehicle tank with the seal of the vapor return means being effective.

Accordingly, when the spout 14 is in the position of FIG. 5, vapor within the tank can flow through the opening 15 in the fill pipe 16 and the opening 89 into the annular passage 86 from which it flows to the vapor recovery equipment. Thus, the movement of the spout 14 into the fill pipe opening 15 results in the seal between the disc 95 and the retainer 100 being broken whereby the vapor can be removed from the tank being filled.

It should be understood that a spring 110 continuously urges the disc 95 into engagement with the retainer 100. The upper end of the spring 110 engages an annular sleeve 111, which has its movement limited by engaging the outlet end of the body 10. The annular sleeve 111 enables the vapors to pass between the annular sleeve 111 and the spout 14.

As previously mentioned, the poppet valve 75 is responsive to the diaphragm 70, which has one end of a spring 115 acting thereagainst. The other end of the spring 115 acts against the retainer 71. A spring 116 has one end disposed in a groove in the poppet valve 75 so that the spring 116 urges the poppet valve 75 to its closed position, but the force of the spring 116 is not as strong as the force of the spring 115, which urges the poppet valve 75 to its normally open position through a rivet in the diaphragm 70 being held against the end of the poppet valve 75 by the spring 115.

However, if the vapor pressure in the tank, which is being filled and has the fill pipe opening 15 sealed by the flat surface 96 of the disc 95 engaging the end of the fill pipe 16, increases beyond a predetermined pressure, the diaphragm 70 is moved against the force of the spring 115 to permit the poppet valve 75 to move to its closed position in response to the action of the spring 116. When this occurs, air from the opening 59 to the passages 30 in the seat ring 26 is stopped so that the partial vacuum in the chamber 36 is increased to cause automatic closing of the main poppet valve 19. This response of the diaphragm 70 to the vapor pressure in the sealed tank is more particularly shown and described in the aforesaid Wood patent.

Considering the operation of the present invention, the poppet valve 75 is normally in an open position as shown in FIG. 1. With the valve 75 in this position and the spout 14 disposed in the fill pipe opening 15, opening of the main poppet valve 19 by the handle 22 causes the flow of liquid through the body 10. Flow continues through the body 10 and the spout 14 until the tank is filled to a predetermined level at which the opening 59 to the vacuum tube 58 is blocked. When this occurs, the partial vacuum in the chamber 36 increases because of the absence of air from the opening 59 to the passages 30 in the seat ring 26 so that the diaphragm 33 moves upwardly to cause automatic closing of the main poppet valve 19.

If the vapor pressure in the tank should exceed a predetermined pressure, the diaphragm 70 moves the poppet valve 75 to its closed position. When this occurs, the partial vacuum in the chamber 36 is increased in the same manner as when the opening 59 to the vacuum tube 58 is blocked by the level of the liquid in the tank being filled since the partial vacuum in the chamber 36 is increased because of the inability of the venturi to draw air from the opening 59 through the passages 30 in the seat ring 26 because of the poppet valve 75 being closed.

When the main poppet valve 19 closes, liquid flow through the nozzle body 10 is stopped. As a result, no further venturi effect is created so that the lips 40 and 41 (see FIG. 2) of the duckbill check valve 38 return to their engaged or sealed position. The lips 40 and 41 of the duckbill check valve 38 engage to trap the partial vacuum in the chamber 36 to remain therein. As a result, the diaphragm 33 is held in a position (see FIG. 8) in which the attendant cannot latch the automatic shut-off mechanism.

However, because the pressure of the air in the chamber 31 is greater than in the chamber 36 since the chamber 36 has the partial vacuum trapped therein, air flows through the passage 46 in the extension 44 and the passage 45 in the extension 44 and the body 43 to the chamber 36. The small diameter of the passage 46 meters the flow of air to the chamber 36 so that the diaphragm 33 cannot return for a predetermined period of time to the position in which latching of the shut-off mechanism can occur. The diameter of the passage 46 and its length control the flow which in turn controls the pressure differential so as to determine the period of time required for the chamber 36 to have sufficient air supplied thereto to enable the diaphragm 33 to be returned to its latching position.

As a result, the attendant cannot return the shut-off mechanism to its latched position as soon as flow through the nozzle body 10 is stopped. Instead, the period of time, which may be ten seconds, for example, required for the diaphragm 33 to return to the latching position must elapse before latching of the shut-off mechanism can again occur.

Figure 6:
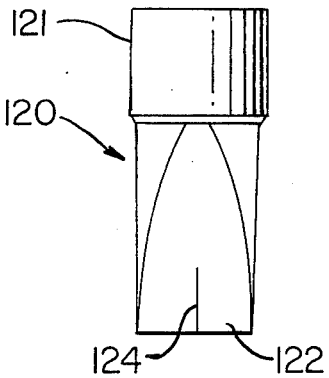
FIG. 6 is a side elevational view of a modification of the control means of the present invention.
Figure 7:
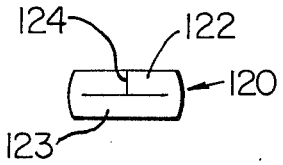
FIG. 7 is an end view of the control means of FIG. 6 in its closed position.
Figure 8:
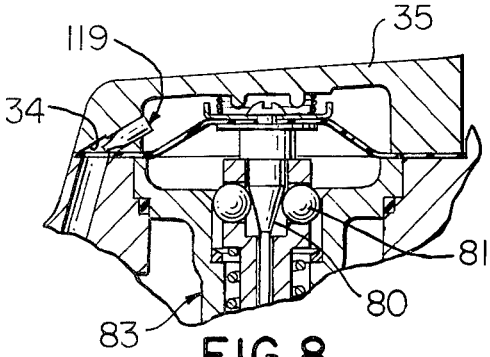
FIG. 8 is a sectional view of a portion of the nozzle of FIG. 1 and showing the control means of FIG. 6 mounted therein with the diaphragm in the position in which the shut-off mechanism has been activated to close the main poppet valve to stop flow through the nozzle.

Referring to FIGS. 6 to 8, there is shown a control means 119. The control means 119 includes a duckbill check valve 120, which is disposed in the passage 34 in the cap 35 as shown in FIG. 8, rather than in the passage 32 in the body 10. This enables the duckbill check valve 120 to be employed with a nozzle which is already installed. The control means 37 requires the passage 32 in the nozzle body 10 to be bored larger than in nozzles which are already installed because of the size of the control means 37. Therefore, the control means 37 cannot be readily utilized with a nozzle which is already installed. Thus, the duckbill check valve 120 enables a nozzle which is already installed to have the control means of the present invention easily added thereto.

The duckbill check valve 120 has a hollow cylindrical shaped body 121 and a pair of lips 122 and 123 formed integral therewith and extending from one end thereof. The lips 122 and 123 normally engage each other to form a seal therebetween. However, when a lesser pressure is applied to the lips 122 and 123 of the duckbill check valve 120 than exists in the chamber 36, air is withdrawn from the chamber 36 to increase the vacuum therein. Thus, the duckbill check valve 120 functions in the same manner as the duckbill check valve 38 during the increase of the partial vacuum within the chamber 36.

However, to meter the air to the chamber 36 when flow of liquid through the nozzle body 10 is stopped, the lip 122 has a slit 124 formed therein. The slit 124 is formed in the lip 122 by cutting the lip 122 with a razor blade, for example.

The slit 124 meters the air from the passage 32 to the chamber 36 in the same way as the passage 46 in the insert 42. Thus, the slit 124 prevents the automatic shut-off mechanism being latched for a predetermined period of time after it has been activated. It should be understood that each of the lips 122 and 123 could have one of the slits 124 formed therein if desired.

Figure 9:
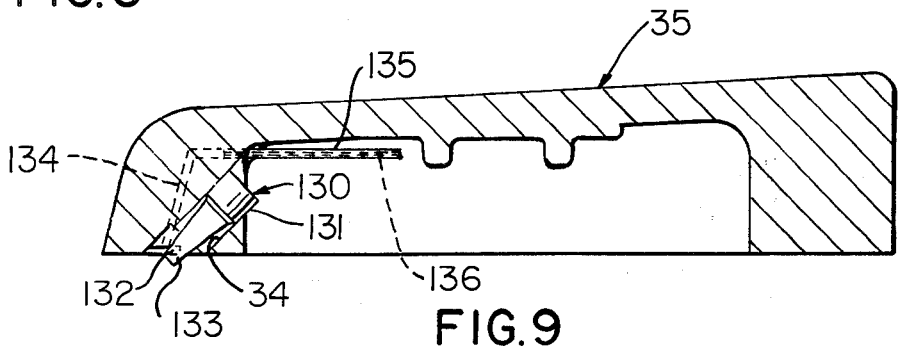
FIG. 9 is a sectional view of a cap of the nozzle of FIG. 1 with another modification of the control means of the present invention.

Referring to FIG. 9, there is shown another form of the control means of the present invention in which a duckbill check valve 130 is installed in the passage 34 in the cap 35. The duckbill check valve 130 includes a hollow cylindrical shaped body 131 having a pair of lips 132 and 133 formed integral therewith and extending from one end thereof. The lips 132 and 133 normally engage each other to form a seal therebetween. However, when the venturi causes a lesser pressure to be applied to the lips 132 and 133 of the duckbill check valve 130 than exists in the chamber 36, air is withdrawn from the chamber 36 to increase the vacuum therein in the same manner as previously described for the duckbill check valve 38.

The cap 35 has a bypass passage 134 formed therein to provide communication from the chamber 36 to the passage 32 in the body 10 while bypassing the duckbill check valve 130. A tubing 135 is inserted into the end of the bypass passage 134 and secured thereto by suitable means such as glue, for example. The tubing 135 has a passage 136 of a relatively small diameter such as 0.007" and a length of seven inches formed therein. The passage 136 in the tubing 135 meters the flow of air to the chamber 36 after the shut-off mechanism has been activated. The diameter and/or length of the passage 136 determine the period of time required for the chamber 36 to have sufficient air supplied thereto to return the diaphragm 33 to the position in which latching of the shut-off mechanism can be accomplished by the attendant.

Figure 10:
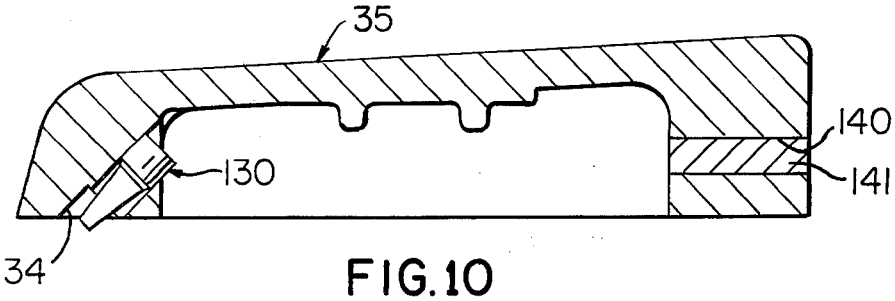
FIG. 10 is a sectional view of a cap of the nozzle of FIG. 1 with another embodiment of the control means of the present invention.

Referring to FIG. 10, there is shown another form of the control means of the present invention which the cap 35 has the duckbill check valve 130 mounted therein in the same manner as shown in FIG. 9. Thus, the duckbill check valve 130 functions in the same manner as described for the modification of FIG. 9.

The cap 35 has a passage 140 formed therein to provide communication between the chamber 36 and the ambient. An insert 141, which is formed of a porous material such as powdered aluminum or stainless steel or plastic, for example, is disposed in the passage 140. By selecting the porous size of the material of the insert 141 in conjunction with the length of the passage 140, the insert 141, which is press fitted in the passage 140, meters the rate of flow of air into the chamber 36 from the ambient to determine when the diaphragm 33 is returned to the latching position.

Figure 12:
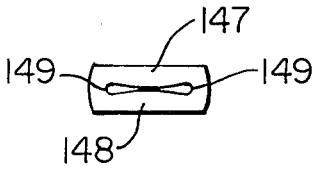
FIG. 12 is an end view of the control means of FIG. 1 when air flow to the vacuum chamber is being metered.
Figure 11:
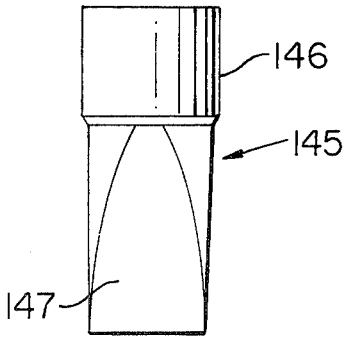
FIG. 11 is a side elevational view of a further modification of the control means of the present invention.
Figure 13:
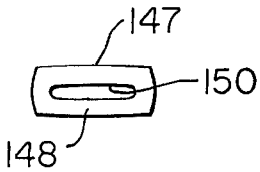
FIG. 13 is an end view of the control means of FIG. 11 when the control means is in its open position to permit uncontrolled flow of air from the vacuum chamber.

Referring to FIGS. 11-13, there is shown a duckbill check valve 145 for disposition within the passage 34 in the cap 35 in the same manner as the duckbill check valve 120 of FIGS. 6-8. The duckbill check valve 145 includes a hollow cylindrical shaped body 146 having a pair of lips 147 and 148 formed integral therewith and extending from one end thereof. The lips 147 and 148 normally engage each other to form a seal therebetween. However, when a lesser pressure is applied to the lips 147 and 148 of the duckbill check valve 145 than exists in the chamber 36, air is withdrawn from the chamber 36 to increase the vacuum therein in the same manner as previously described for the duckbill check valve 120.

When the lips 147 and 148 are in their closed or sealed position, one or more orifices 149 exists therebetween at their ends as shown in FIG. 12. When the lips 147 and 148 are in their open position, a large opening 150 is provided therebetween as shown in FIG. 13.

The orifices 149 are formed by heating a rectangular shaped metallic shim of 0.003" to 0.005" thickness between the lips 147 and 148 thereby forming a passage therethrough at the sealing surface and preventing full sealing of lips 147 and 148. The orifices 149 meter the air into the chamber 36 to control the period of time that it takes the chamber 36 to have sufficient pressure to return the diaphragm 33 to the position in which the shut-off mechanism can be latched.

Figure 14:
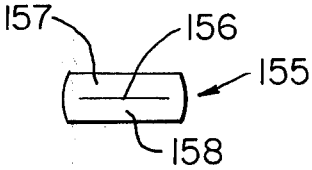
FIG. 14 is an end view of a further embodiment of the control means of the present invention with the control means in a position in which air flow to the vacuum chamber is being metered.

Referring to FIG. 14, there is shown a duckbill check valve 155 having an orifice 156 formed between its lips 157 and 158. The orifice 156, which is formed by heating a hot wire between the lips 157 and 158, meters the air into the chamber 36 to control when the diaphragm 33 is returned to the position in which latching of the shut-off mechanism can occur.

The duckbill check valve 155 would be disposed in the passage 34 in the cap 35 in the same manner as the duckbill check valve 120. The operation of the duckbill check valve 155 is the same as that previously described for the duckbill check valve 120 except that the orifice 156 meters the air flow into the chamber 36 rather than the slit 124 in the duckbill check valve 120 of FIGS. 6-8.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. An automatic shut-off nozzle comprising a body having an inlet and an outlet, a valve in said body controlling flow of liquid from said inlet to said outlet, manual operated means controlling the operation of said valve, a spout communicating with said outlet and having its free end for disposition in an opening of a fill pipe of a vehicle tank or the like, release means movable from a latching position in one direction to release said manual operated means in response to at least one condition existing in the tank and acting on said manual operated means to allow closing of said valve and stoppage of liquid flow, a chamber, a diaphragm forming a wall of said chamber and having said release means connected thereto, means communicating said chamber with the tank, means to create a partial vacuum in said chamber when liquid is flowing through said body, means to increase the vacuum in said chamber when the one condition exists in the tank to cause said diaphragm to move said release means in the one direction, and means to control the reduction of the vacuum in said chamber after said release means has been moved in the one direction to release said manual operated means to prevent return of said release means to its latching position for a predetermined period of time.

2. The nozzle according to claim 1 in which said control means includes check valve means in said communicating means to allow removal of air from said chamber by said partial vacuum creating means while preventing uncontrolled flow of air to said chamber, and means, separate from said check valve means, to meter the flow of air into said chamber after said release means has been moved in the one direction to release said manual operated means.

3. The nozzle according to claim 2 in which said separate means is disposed in said communicating means.

4. The nozzle according to claim 2 in which said separate means includes separate communicating means providing communication from said chamber to the ambient and metering means in said separate communicating means to meter the flow of air into said chamber after said release means has been moved in the one direction to release said manual operated means.

5. The nozzle according to claim 2 in which said separate means includes bypass communicating means providing communication between said communicating means and said chamber while bypassing said check valve means in said communicating means and metering means in said bypass communicating means to meter the flow of air into said chamber after said release means has been moved in the one direction to release said manual operated means.

6. The nozzle according to claim 1 in which said control means includes check valve means in said communicating means to allow removal of air from said chamber by said partial vacuum creating means while preventing uncontrolled flow of air into said chamber, said check valve means has means to meter the flow of air into said chamber after said release means has been moved in the one direction to release said manual operated means.

7. The nozzle according to claim 6 in which said check valve means is a duckbill check valve, said duckbill check valve includes a pair of lips to allow removal of air from said chamber when separated and to prevent uncontrolled flow of air into said chamber when engaged, and said duckbill check valve has a controlled orifice in at least one of said lips to form said metering means to meter flow of air into said chamber after said release means has been removed in the one direction to release said manual operated means.

8. The nozzle according to claim 6 in which said check valve means is a duckbill check valve, said duckbill check valve includes a pair of lips to allow removal of air from said chamber when separated and to prevent uncontrolled flow of air into said chamber when engaged, and said duckbill check valve has orifice means between said lips to form said metering means to meter flow of air into said chamber after said release means has been moved in the one direction to release said manual operated means.

9. The nozzle according to claim 6 in which said check valve means is a duckbill check valve, said duckbill check valve includes a pair of lips to allow removal of air from said chamber when separated and to prevent uncontrolled flow of air into said chamber when engaged, and said metering means includes passage means supported by said duckbill check valve and bypassing said lips.

10. The nozzle according to claim 1 in which said control means includes means in said communicating means to allow removal of air from said chamber by said partial vacuum creating means while preventing flow of uncontrolled air to said chamber and means to meter the flow of air into said chamber after said release means has been moved in the one direction to release said manual operated means.

11. A valve for allowing fluid flow therethrough in one direction in response to a pressure differential on opposite sides thereof and metering fluid flow in the other direction when the pressure differential producing the fluid flow in the one direction does not exist, said valve including a hollow body having a pair of flexible lips movable apart in response to the pressure differential to allow fluid flow in the one direction and means to meter the fluid flow in the other direction when the pressure differential producing the fluid flow in the one direction does not exist so that said lips are engaged.

12. The valve according to claim 11 in which at least one of said lips has said metering means.

13. The valve according to claim 11 in which said lips have said metering means formed therebetween when said lips are engaged.

14. The valve according to claim 11 in which said body has passage means extending therethrough and by-passing said lips, said passage means forming said metering means.

* * * * *